United States Patent [19]

Shriver

[11] 4,210,684

[45] Jul. 1, 1980

[54] PROTECTIVE COATING FOR CANS AND METHODS FOR APPLICATION OF COATING THERETO

[75] Inventor: Frank L. Shriver, Lakewood, Colo.

[73] Assignee: Coors Container Company, Golden, Colo.

[21] Appl. No.: 891,309

[22] Filed: Mar. 29, 1978

[51] Int. Cl.[2] ..... B05D 1/28; B05D 5/00

[52] U.S. Cl. ..... 427/286; 118/211; 118/212; 118/218; 118/219; 118/230; 118/232; 427/284; 427/428

[58] Field of Search ..... 427/286, 284, 428; 118/211, 212, 218, 219, 230, 232, 239, 112

[56] References Cited

U.S. PATENT DOCUMENTS

| | | | |
|---|---|---|---|
| 297,600 | 4/1884 | Hausheer | 118/219 X |
| 805,833 | 11/1905 | Ayars | 118/219 |
| 935,229 | 9/1909 | Phelps | 118/219 X |
| 942,951 | 12/1909 | Wild | 118/218 |
| 2,124,722 | 7/1938 | Walter | 118/232 |
| 2,388,911 | 11/1945 | Fink | 118/232 |
| 2,495,174 | 1/1950 | McClatchie | 118/230 X |
| 2,531,914 | 11/1950 | Lager et al. | 118/211 X |
| 2,543,895 | 3/1951 | Corbett | 118/232 |
| 3,424,127 | 1/1969 | Johnson et al. | 427/286 X |
| 3,563,781 | 2/1971 | Johnson | 427/286 X |

OTHER PUBLICATIONS

"Coating Equipment and Processes", Booth, 1970, Lockwood Publishing Co. Inc., N.Y., N.Y, pp.149–153.

*Primary Examiner*—Shrive P. Beck

*Attorney, Agent, or Firm*—Bruce G. Klaas; Dennis K. Shelton

[57] ABSTRACT

Apparatus and methods of applying a thin narrow width coating to can body members comprising a feed control means associated with a guideway means for causing rotating moving of the can body members across an elongated coating applicator roller member extending parallel to the path of movement of the can body members, the rotation of and spacing of the can body members and the rotation of the applicator roller member being controlled to apply the coating during substantially only one revolution of the can body member and less than one revolution of the roller member.

11 Claims, 9 Drawing Figures

PROTECTIVE COATING FOR CANS AND METHODS FOR APPLICATION OF COATING THERETO

BACKGROUND AND SUMMARY OF THE INVENTION

This invention relates to containers and, more particularly, to metallic containers made of relatively thin sheet metal, such as aluminum.

Thin wall aluminum beverage cans have been widely used for some time and are conventionally sold in six pack containers. In recent years, considerable efforts have been devoted to reducing packaging costs and several types of packaging devices have been developed which comprise a sheet of material having apertures for receiving and holding the top portions of the cans with the lower portions of the side walls of the cans located in abutting relationship to stabilize the six pack. As a result, abutting lower portions of the can are subject to abrasion during handling prior to consumption of the contents resulting in loss of appearance and even in holes in the lower portion of the side wall under severe conditions.

The present invention provides for an abrasion resistant coating on the lower side wall portion of a can which prevents abrasion resulting in holes in the can. The invention also provides methods and apparatus for applying an abrasion resistant coating to the lower side wall portion of a can during high speed production of cans. More specifically, the methods and apparatus of the present invention enable the application of an abrasion resistant coating to the lower side wall portion of a one-piece aluminum can body member after completion of the manufacture of the can body member and prior to filling and closure of the can body member by application of an end member thereto.

BRIEF DESCRIPTION OF THE DRAWINGS

An illustrative and presently preferred embodiment of the invention is shown in the accompanying drawing in which.

DETAILED DESCRIPTION

Figure 1:
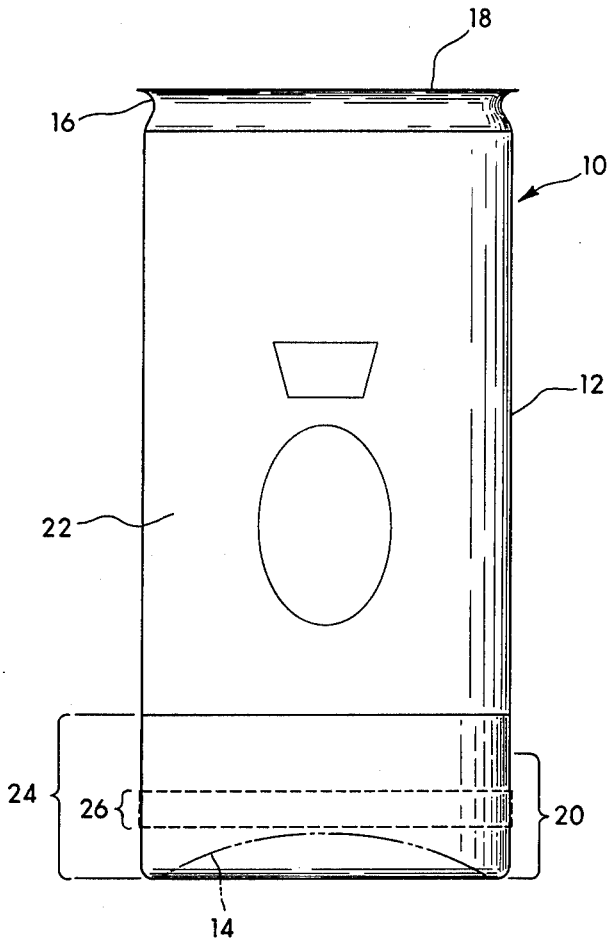
FIG. 1 is a side elevational view of a one-piece can body member having an abrasion resistant coating on a lower side wall portion thereof.

Referring to FIG. 1, a one-piece can body member 10 made of relatively thin, e.g., 0.005 inch, aluminum sheet material is shown to comprise a cylindrical side wall portion 12, a bottom wall portion 14, and a flanged upper end portion 16 surrounding an opening 18 which is subsequently used to attach an end member (not shown) to form a closed sealed can after filling of the can. The can body member is constructed such that the lowermost part 20 of side wall portion 12 is slightly outwardly tapered and is of larger diameter than any other part of the side wall portion. In addition, after the can has been completed by attachment of an end member, the lowermost part 20 of the side wall portion 12 is of larger diameter than any other part of the can including the end member. Thus, when multiple cans are held in a vertical position in close abutting relationship, only the lowermost parts 20 of the side wall portions 12 of adjacent cans abut one another.

The can body member may further comprise a printed ink label area 22 which terminates above the lowermost side wall portion 20 to leave an unprinted aluminum band 24 therebelow including the lowermost side wall portion 20. A relatively thin, i.e., 0.0025 to 0.003 inch, band of protective abrasion resistant coating material 26 is provided on the lowermost side wall portion 20. The thickness of the band of coating material 26 is such as to prevent contact between adjacent cans in a six pack except at the band of coating material 26. The width of the band of coating material may be between approximately $\frac{1}{8}$ inch to $\frac{1}{2}$ inch and, preferably, between 3/16 inch and $\frac{1}{4}$ inch, to reduce cost and to provide more label space. In the presently preferred embodiment, the coating material is an abrasion resistant clear acrylic type lacquer which is curable by ultra violet light and/or heat.

Figure 2:
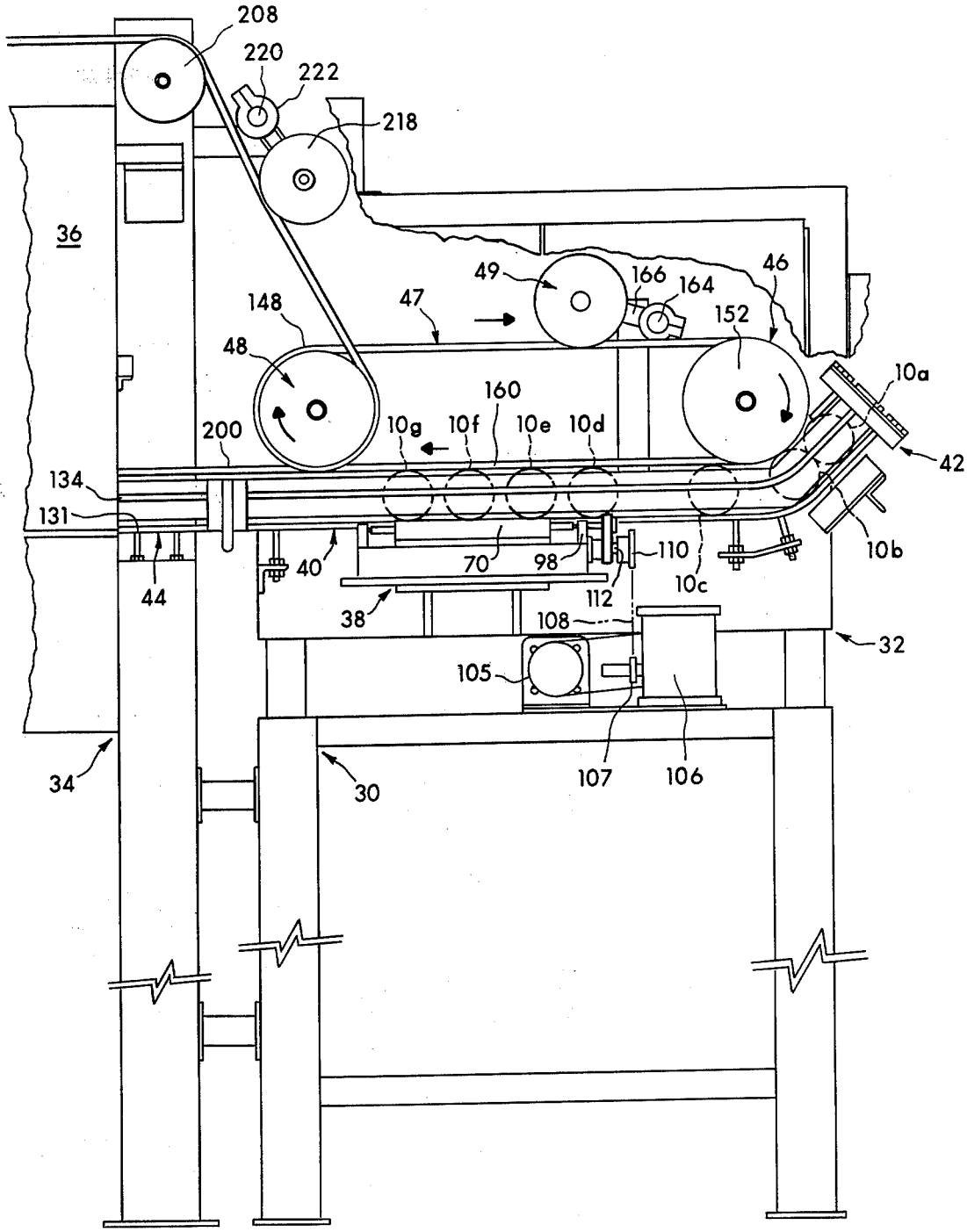
FIG. 2 is a side elevational view, with parts removed, of a portion of an apparatus for applying the abrasion resistant coating.
Figure 4:
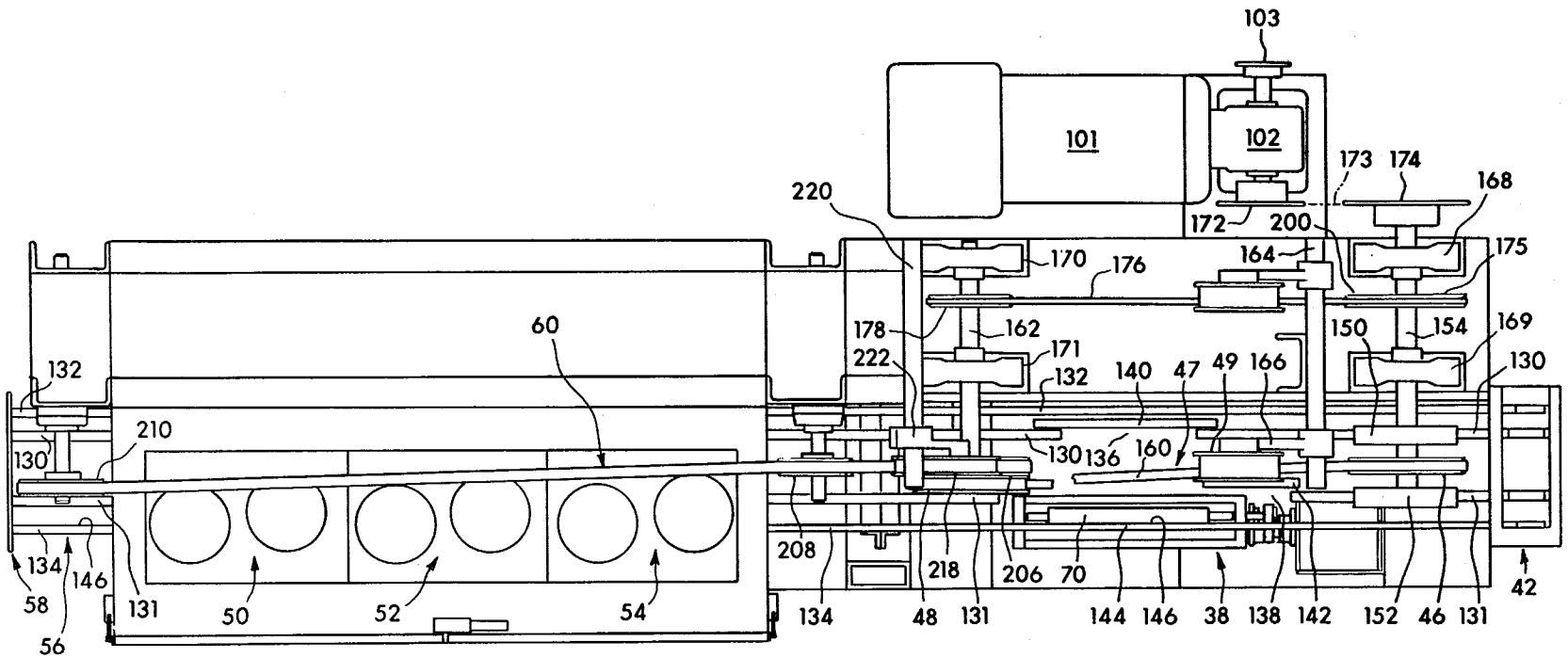
FIG. 4 is a plan view of the apparatus of FIG. 2.

Referring now to FIGS. 2 and 4, apparatus for applying the band of coating material 26 is shown to generally comprise frame means 30 for supporting coating applying means 32 for applying lacquer to can body members 10*a*–10*g*. A frame means 34 is provided for supporting coating curing means 36 for curing the lacquer after application to the can body members.

In general, the coating applying means 32 comprises roller applicator means 38 for applying the lacquer to the can body members and mounted in juxtaposition to guide track means 40 for guidably supporting the can body members during movement from feed chute assembly 42 to a connecting chute assembly 44 where the can body members enter the coating curing means 36. Can body member feed control means are provided for causing controlled movement of the can body members along the guide track means 40 which comprise a sheave means 46 adjacent the inlet chute means and a belt means 47 extending from the sheave means 46 across and beyond the roller applicator means 38 to a sheave means 48 with a tensioning and guide sheave means 49 located thereabove.

In general, the coating curing means 36 comprises ultra violet light means 50, 52, 54, FIG. 4, for curing the lacquer which are mounted in juxtaposition to guide track means 56 for guidably supporting the can body members during movement from connecting chute assembly 44 to a discharge chute assembly 58 where the can body members leave the curing means 36. Conveyor belt means 60 are provided for causing movement of the can body members along the guide track means 56.

Referring now to FIGS. 6–9, the roller applicator means 38 comprises an elongated applicator roller member 70 having a central axis of rotation 72, which extends parallel to the path of movement of the container end members 10*a*–*g* as indicated by arrow 74 and rotatable in the direction of arrow 75. The entire periphery of roller member 70 may be provided with suitable coating pocket or groove means, such as a plurality of longitudinally extending parallel serrations 76, FIG. 9, of triangular cross-section which extend parallel to the axis of rotation 72 for smooth uniform application of the coating to the can body members. In the presently preferred embodiment, roll member 70 has a diameter of approximately 1 inch and there are a substantial number of serrations, e.g. 77 for the one inch diameter roller member, so as to provide a plurality of relative sharp, narrow width contact edges 78 having lacquer pockets 80, 82 on each side thereof. A lacquer supply and metering roller member 84, preferably of 1.5 inch diameter, is rotatably mounted beneath roller member 70 and partially immersed in a lacquer reservoir 86 from which lacquer is carried by the roller member 84 and transferred to the roller member 70. The roller members 70, 84 are preferably made of non-corrosive heat resistant material, such as stainless steel, so as to enable the maintenance of very accurate dimensional relationships as to coating thickness.

Figure 5:
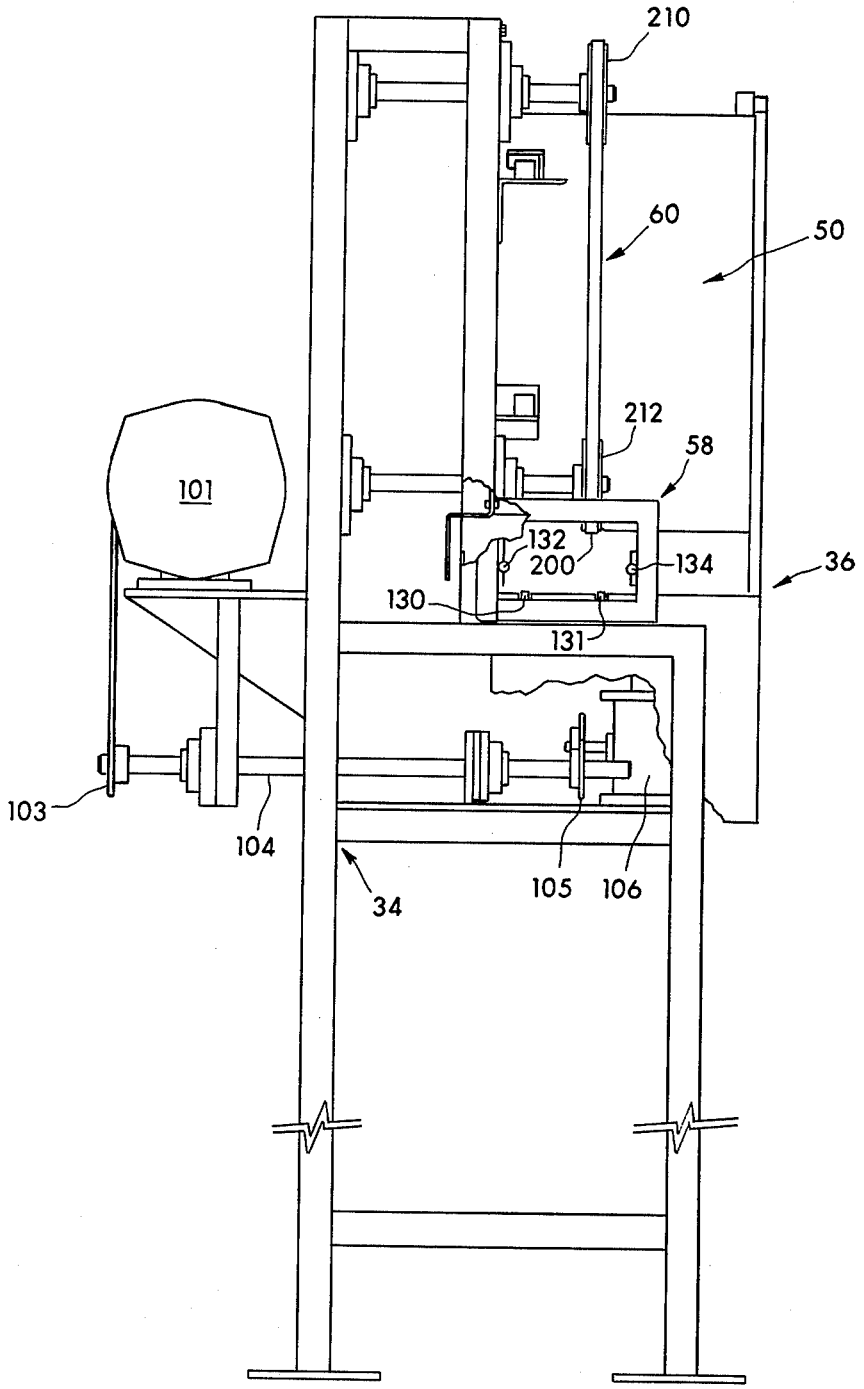
FIG. 5 is an end view of the apparatus of FIG. 2.

The roller members 70, 84 have stub shaft end portions 90, 92 and 94, 96, respectively, which are rotatably supported by suitable bearing means (not shown) in end plate members 98, 100. The roller members are positively driven in predetermined relationship by a motor means 101, FIG. 5, through gear box 102, FIG. 4, sprocket and chain means 103, a shaft 104, FIG. 5, sprocket and chain means 105, a speed reducing gear box 106, a drive sprocket member 107, a drive chain member 108, and a driven sprocket 110 mounted on a drive shaft member 112 which is suitably supported by end plate member 98. A timing belt member 114 is driven by a sprocket member 116 mounted on shaft 112 and drives a sprocket member 118 drivably mounted on shaft portion 90 to cause rotation of roller member 70. Roller member 84 is positively driven by a spur gear member 120, FIG. 8, mounted on shaft 112 in driving engagement with a spur gear member 122, FIG. 6, drivably mounted on shaft portion 94. The arrangement and construction of the presently preferred embodiment is such that roller member 70 has uniform constant rotation of 60 R.P.M., with no slippage permitted by the use of the timing belt and sprocket members, while roller member 84 has uniform constant rotation of approximately 40 R.P.M. The reservoir 86 is provided with drainage openings 124, 126.

Figure 3:
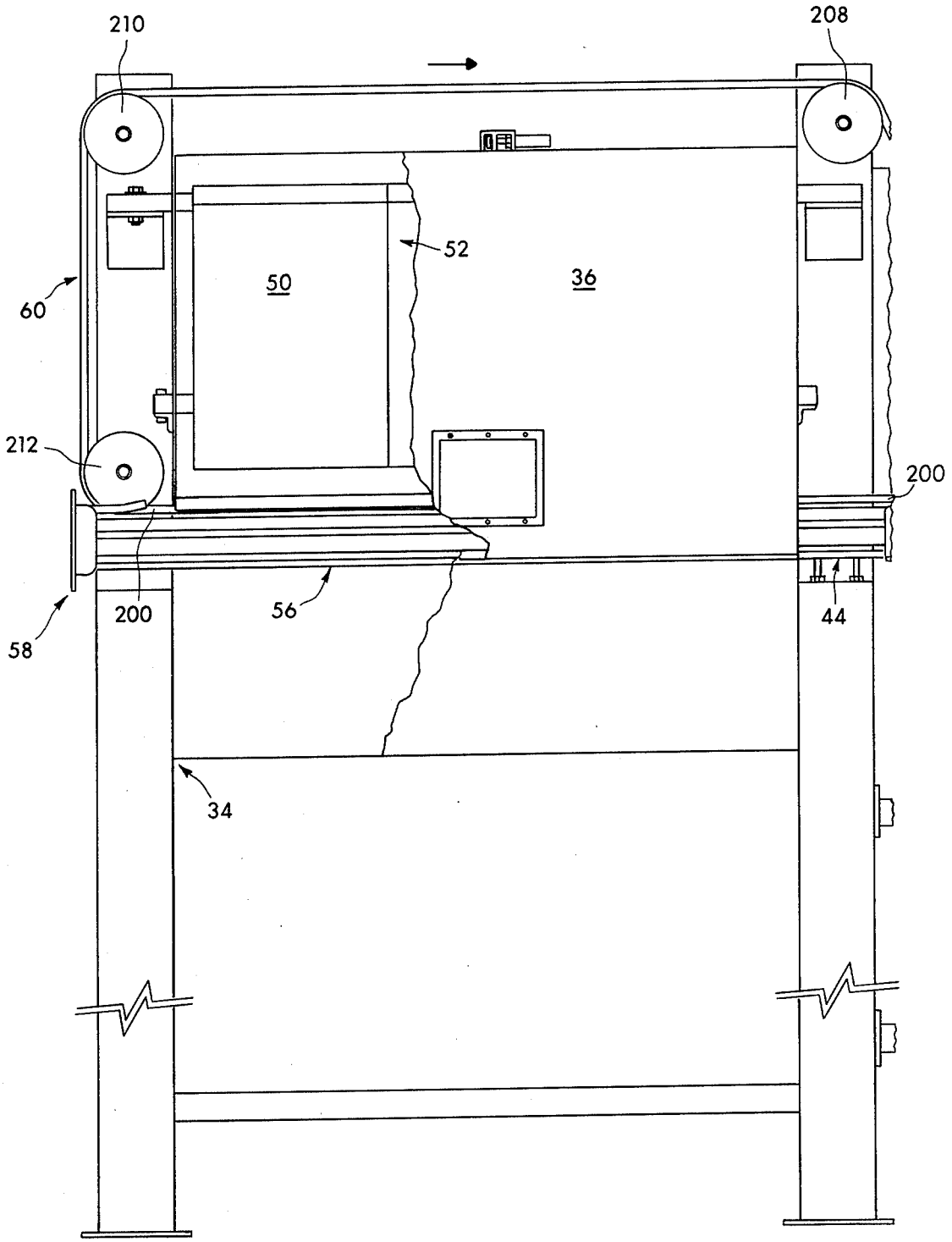
FIG. 3 is a side elevational view, with parts removed, of another portion of the apparatus of FIG. 2.

Referring now to FIGS. 2–4, guide track means 40 comprises a conventional arrangement of spaced lower 130, 131 and side 132, 134 guide rod or bar members defining a guideway having a cross-sectional area similar to the shape of the can body members. The bottom guide rod members 130, 131, FIG. 4, are discontinuous with axial gaps 136, 138 adjacent the coating applicator means 38 and transversely offset guide rod members 140, 142 provided to enable engagement of the can body members with the roller member 70 therealong. The portion 144 of side guide member 134 is located outwardly of the center of rotation of roller member 70 to accurately locate the bottom of can body members relative to the roller member 70 by abutting slidably engagement with the inner side surface 146.

Can body member feed control means are provided by the arrangement of the drive belt means 47 and sheave members 46, 48 and 49 for controlling the spacing and movement of the can body members along the roller member 70. As shown in FIG. 2, the drive belt means 47 is a conventional gripping type V-belt having a flat outer surface 148 extending beyond the outer periphery of the sheave members 46 & 48 so as to be engageable with the outer periphery of the can body members. In addition, a pair of feed roller members 150, 152, having rubber coated peripheral surfaces, are mounted on a shaft member 154 on opposite sides of sheave member 46 with diameters slightly larger than the diameter of the sheave member 46 by the width of the V-belt for holding can body members **10*a* and 10*b* in stacked abutting relationship and for feeding can body members 10*c* thereby in spaced relationship on the guide track means 40 as illustrated in FIG. 2. The arrangement and construction of the drive belt means 47 and sheave members 46, 48, 49 is such as to incline the lowermost portion 160 of the drive belt so that it converges toward the side guide rod member 134 to hold the can body members in abutting engagement with side surface 146 thereof. Sheave member 48 is mounted on shaft member 162, and sheave member 49 is mounted on shaft member 164 by an adjustment arm 166. Shaft members 154, 162 are mounted on suitable bearing means 168, 169 and 170, 171, and driven by motor means 101 through drive sprocket 172, chain 173, sprocket 174, a sheave member 175, a belt member 176, and a sheave member 178, FIG. 4**.

Figures 6, 7:
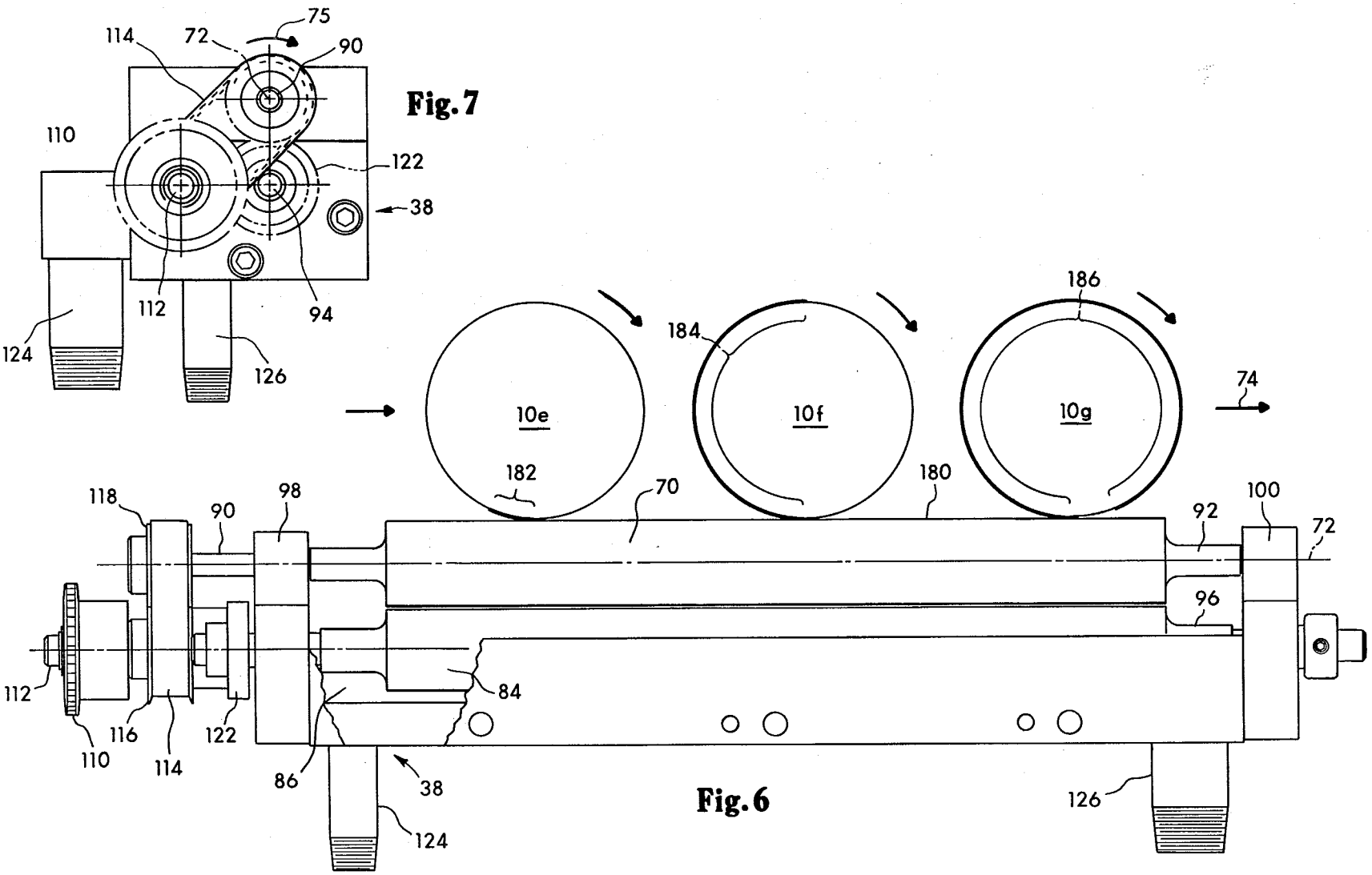
FIG. 6 is an enlarged side elevational view, partly in section, of the coating application apparatus of FIG. 2.
FIG. 7 is an end view of the apparatus of FIG. 6.
Figure 8:
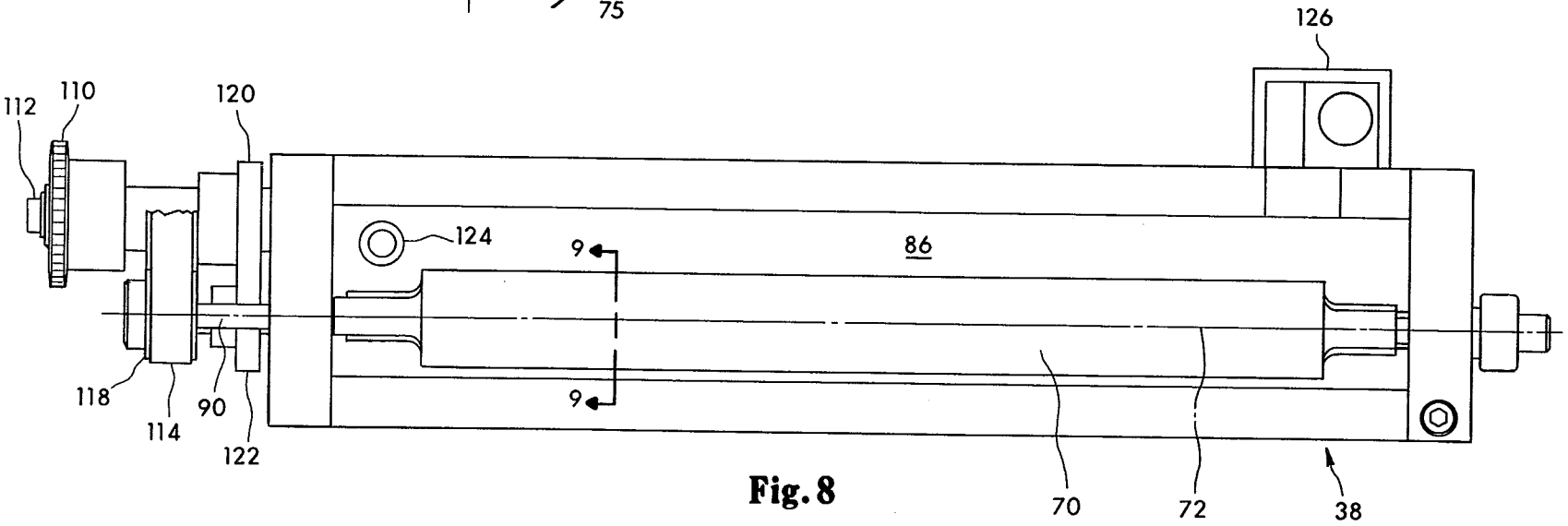
FIG. 8 is a plan view of the apparatus of FIG. 6.
Figure 9:
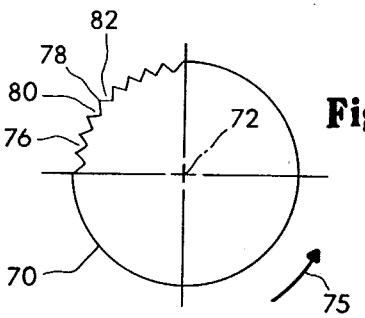
FIG. 9 is an enlarged cross-sectional view of the coating applicator roller of FIG. 6 taken along the line 9—9 in FIG. 8.

In operation, the can body members **10*e*, 10*f*, 10*g*, FIG. 6, are rotatably driven by frictional engagement with the lower portion 160 of belt means 47 into engagement with the uppermost portion 180 of roller member 70 and into engagement with guide rod side surface 146 and along the length of the roller member 70 in uniformly spaced relationship. The length, diameter and rotational velocity of the roller member 70; the diameter and rotational velocity of the can body members; and the velocity of the belt means 47 are correlated so that each can body member rotates one full revolution while in contact with roller member 70 but no more than is necessary to assure completion of the annular coating applied thereto by only a small circumferential length overlap of the coating. As shown in FIG. 6, at the portions of can body members 10*e*, 10*f* and 10*g*, the varying circumferential lengths of the coating are represented by brackets 182, 184, 186**.

In the presently preferred embodiment, the axial spacing between centers of can body members **10*e*, 10*f* and 10*g* is approximately 3 inches, the axial length of roller member 70 is approximately 9 inches, the can body member is coated with approximately ⅛ inch overlap during 90° of revolution of roller member 70, and approximately ten can body members per second traverse the length of the roller member 70. The coating material in the reservoir is heated to approximately 110° F.±5° by suitable heating means (not shown) which enables the thickness of the coating to be accurately controlled. Preferably, the can body members are at an elevated temperature of approximately between 110° F. to 120° F. The heating of the can body members may be accomplished by immediately transferring the can body members from a label ink curing oven (not shown) immediately upstream of the apparatus inlet chute 42 whereat elevated can body member temperatures are acquired during curing of the printed ink label portions 22**.

Immediately after application of the coating, the can body members are moved by the lower belt portion 160 of belt means 47, into frictional driving engagement with a lower inclined belt portion 200 of belt means 60 to continue the rotating movement of the can body members in uniform spaced relationship along the guideway means 40 into and through the curing oven means 36. Belt member 60 is driven by a sheave member 206 on shaft 162 over guide sheave members 208, 210, 212, with the lower portion 200 between sheave members 206 and 212, being inclined to cause the can body members to continue to abut the side surface 146 of side guide bar 134 and be properly positioned relative to the oven means 50, 52, 54. A belt tensioning sheave member 218 is mounted on a support shaft member 220 by an adjustment arm member 222.

It is contemplated that the illustrative and presently preferred embodiment of the invention, as hereinbefore described, may be variously modified and adapted to particular uses and it is intended that the appended claims be construed to include alternative embodiments of the invention, except insofar as limited by the prior art.

What is claimed is:

1. Apparatus for simultaneously applying a thin narrow width annular coating to a portion of the outer peripheral cylindrical surface of a plurality of can body members or the like between the end edge surfaces thereof comprising:

elongated conveyor means for rotatably transporting the can body members therealong in equally spaced relationship in a horizontal attutude along a horizontal path of movement;

elongated coating means mounted below and associated with said elongated conveyor means for simultaneously engaging and applying the thin narrow width annular coating to lowermost portions of the plurality of can body members during passage of the can body members therealong;

the coating means including an elongated coating application roller member mounted in a horizontal attitude and having an axis of rotation extending parallel to the direction of movement of the can body members and transversely to the central longitudinal axes thereof and having an elongated narrow width upper peripheral portion located along the path of movement of the can body members for engagement with a narrow width peripheral portion of the outer peripheral cylindrical surface of each of the can body members between the end edge surfaces thereof during rotating movement of the can body members therealong; and can body member drive means mounted above said coating means and extending along said elongated conveyer means for causing rotation and movement of the can body members along the roller member and engagement therebetween to effect coating of each of the can body members during substantially only one revolution thereof and to uniformly space the can body members along the roller member.

2. The invention as defined in claim 1 and wherein said can body member drive means comprising:

a belt member having a drive portion extending generally parallel to and being inclined relative to the longitudinal axis of the roller member to maintain uniform rotational speed and spacing of the can body members therealong.

3. The invention as defined in claim 2 wherein said application coating roller member further comprising:

a generally cylindrical peripheral surface having a plurality of elongated alternating rib and groove portions, the rib portions having a generally triangular cross-sectional configuration providing elongated contact edges for engaging the periphery of the can body members, and the groove portions retaining the coating material to be applied to the can body members.

4. The invention as defined in claim 3 and further comprising:

positive non-slip drive means for causing controlled uniform rotation of said coating application roller member.

5. The invention as defined in claim 4 and further comprising:

reservoir means for holding a supply of the coating material;

a metering roller means mounted in said reservoir means and being engageable with said coating application roller member for transfer and application of coating material to said coating application roller member.

6. The invention as defined in claim 5 and further comprising:

common drive means for both said coating application roller member and said metering roller means for causing uniform controlled relative rotational movement of both.

7. The invention as defined in claim 6 and wherein said common drive means comprising:

a motor means for causing rotation of coating application roller member and the metering roller means;

an input means operable by said motor means for transferring force to said coating application roller member and said metering roller means;

a timing belt and sheave means for connecting said input means to said coating application roller member; and gear means for connecting said input means to said metering roller means.

8. The invention as defined in claim 6 and further comprising:

a conveyor means for conveying the can body members to and across and beyond the coating means; and can body member feed control means for causing rotational movement of the can body members along said conveyor means across and beyond said coating application roller member in predetermined spaced relationship and for causing only slightly more than one revolution of each can body member during movement across said coating application roller member.

9. The invention as defined in claim 8 and wherein said can body feed control means comprising:

separator roller means located upstream of said coating application roller member for separating the can body members and causing a predetermined spacing between adjacent can body members; and belt means extending from the separator roller means beyond said coating application roller member for engaging and rotatably moving the can body member from the separator roller means across and beyond said coating application roller member.

10. The invention as defined in claim 9 and wherein:

said conveyor means including an abutment surface extending parallel to the longitudinal rotational axis of said coating application roller member and being laterally offset to one side thereof a distance such as to locate the circumferential portion of the can body members to be coated in alignment with the outer peripheral portion of the coating application roller member adjacent thereto; and said belt means being inclined relative to said abutment surface for moving the can body members into engagement therewith prior to application of the coating material to the can body members and for maintaining the can body members in engagement therewith during movement along the coating applicator roller member.

11. The invention as defined in claim 10 and wherein: the velocity of said belt means and the rotational speed of said coating application roller member being adjusted so that each can body member completes slightly more than one complete revolution during movement across said coating application roller member.

* * * * *